United States Patent [19]

Lombardo et al.

[11] 4,421,247

[45] Dec. 20, 1983

[54] TWO-PIECE QUAD-SEAL CLOSURE WITH PLUG SHOCK ABSORBING END PANEL

[75] Inventors: Paul Lombardo, Dolton; Leon Patarini, Palos Hills; James Imlah, Elmhurst, all of Ill.

[73] Assignee: The Sherwin-Williams Company, Cleveland, Ohio

[21] Appl. No.: 374,464

[22] Filed: May 3, 1982

[51] Int. Cl.[3] ..... B65D 43/06

[52] U.S. Cl. ..... 220/354; 220/307

[58] Field of Search ..... 220/307, 354

[56] References Cited

U.S. PATENT DOCUMENTS

| | | | |
|---|---|---|---|
| 795,128 | 7/1905 | Hodgson | 220/354 |
| 1,128,076 | 2/1915 | Taliaferro | 220/354 |
| 4,180,179 | 12/1979 | Hoenig et al. | 220/307 |
| 4,220,254 | 9/1980 | Morton | 220/354 |

*Primary Examiner*—George T. Hall

*Attorney, Agent, or Firm*—James V. Tura; Robert E. McDonald

[57] ABSTRACT

A two-piece shock absorbing closure defined by a ring and a plug, the plug including a centrally generally circular unreinforced concavely axially outwardly opening end panel, an annular axially projecting plug portion bounding the end panel, the ring including an axially opening annular channel for receiving the plug portion, the annular channel being defined by inner and outer channel walls and a bight wall therebetween, a wall radially outboard of the outer channel wall responsive to insertion of the plug portion into the annular channel for radially inwardly deflecting the outer channel wall to bring the same into intimate friction engagement with the plug portion, and another wall between the end panel and the plug portion for effecting the deflection of the end panel from its concave configuration to a convex configuration in response to shock forces imparted to the closure and/or an associated container thereby absorbing said shock forces to prevent plug popping.

21 Claims, 6 Drawing Figures

TWO-PIECE QUAD-SEAL CLOSURE WITH PLUG SHOCK ABSORBING END PANEL

The present invention is an improvement in the QUAD-SEAL SNAP LOCK disclosed in commonly assigned, copending application Ser. No. 335,305 filed Dec. 28, 1981.

The present invention and that disclosed in the latter-identified application are directed to plug and ring closures or triple-tight closures which are relatively well known for packaging therein oil or water based paints. Such closures normally include a plug portion defined by inner and outer walls and a bight or bight wall therebetween and a ring which likewise includes a channel defined by inner and outer walls and a bight or bight wall therebetween. The plug portion is received in the channel of the ring to effect an air-tight seal which is necessarily desirable to prevent oxidation of the contents within an associated container. Over the years, it became necessary or desirable to partially or fully coat the plug and ring, and particularly the sealing surfaces thereof, to reduce oxidation but due to the low coefficients of friction of such coatings, plug retention capability greatly diminished and plugs would pop-off when the packaged can or container was dropped on its side to enter a labelling machine, or a shaker, or during transport, or from overall general abuse. The results of the latter are obvious, namely, lossed product, down time, cleaning costs, equipment damage, etc.

Typical ring and plug closures which evidence such aforementioned undesired "plug popping" are disclosed in, for example, Henchert U.S. Pat. No. 2,775,362 issued Dec. 25, 1956, and Erb U.S. Pat. No. 2,606,685 issued Aug. 12, 1952. Efforts toward reducing or preventing such plugs from popping from their associated rings are found in such patents as Kinnavy et al. (U.S. Pat. No. 3,338,456 issued Aug. 29, 1967) and Hoening et al. (U.S. Pat. No. 4,180,179 issued Dec. 25, 1979). In the latter-noted patents, coatings of low coefficients of friction and interlocking beads and sockets have been utilized in an effort to reduce or eliminate plug popping. Each introduces separate disadvantages to conventional ring and plug closure, namely, expensive coatings and intricate metal forming operations, respectively.

In keeping with the foregoing, the invention disclosed in the aforesaid application provides a novel ring and plug closure of the type in which the plug includes a conventional plug portion defined by inner and outer annular friction walls and a bight wall therebetween which is received in an annular channel of the ring likewise defined by inner and outer friction walls and a bight wall therebetween, and a major object was that of providing means radially outboard of the outer wall of the ring channel which is responsive to the insertion of the plug portion into the annular channel for radially inwardly deflecting the outer channel wall and, thus, the outer friction wall of the plug to increase the frictional purchase between the two and effect clamping action which essentially prevents or greatly reduces conventional plug popping.

The latter object is augmented by constructing the deflecting means as a frusto-conical wall inclined at a predetermined angle to the plane of the outer channel wall, and the predetermined angle progressively reduces as the plug portion is inserted into the channel to effectively increase the friction or clamping action between the plug portion and ring channel.

Somewhat more specifically, the frusto-conical wall is joined to the outer channel wall by a radius in axial alignment with a curl of the plug whereby upon the insertion of the plug portion into the annular channel, the plug curl contacts and exerts a force against the radius of the ring which is transmitted to deflect the frusto-conical wall to lessen its normal predetermined angle until complete closure of the ring and plug is effected.

The invention latter-defined further provided a novel ring and plug closure wherein the inner wall of the plug merges with a channel which receives a curl of the inner channel wall whereby upon complete closure four seals are effected, two at diametrically opposite areas of the latter-mentioned curl and radius and two between the inner and outer channel and plug wall.

In keeping with the present invention the latter-defined structures and objects are further refined through the recognition that prior theories of incorporating reinforcing means, such as circular beading, strengthening configurations, or the like, into wall portions of the conventional plugs or rings to withstand the entire force in plug retention is incorrect and the opposite is, in fact, through, namely, by weakening end panel or end panel area and removing all reinforcing or strengthening features (flat panel) the plug retention properties and thus the anti-plug popping properties have been improved. Thus, in keeping with the foregoing the present invention includes a shock absorbing plug having a generally annular U-shaped plug portion defined by inner and outer plug walls and a bight wall therebetween, the inner and outer walls merging with a respective radius and a curl, a central generally circular unreinforced concavely axially outwardly opening end panel inboard of the radius, the end panel being in part defined by a frusto-conical shock absorbing annular wall joined by a first radius wall to the end panel and by a second radius wall to the first-mentioned radius, and the frusto-conical shock absorbing annular wall being effective for deflecting the end panel from its concave configuration to a convex configuration in response to shock forces imparted to the closure and/or its associated container thereby absorbing such shock forces to further prevent "plug popping" and conversely enhance plug retention.

With the above and other objects in view that will hereinafter appear, the nature of the invention will be more clearly understood by reference to the following detailed description, the appended claims and the several views illustrated in the accompanying drawing.

IN THE DRAWING

Figure 1:
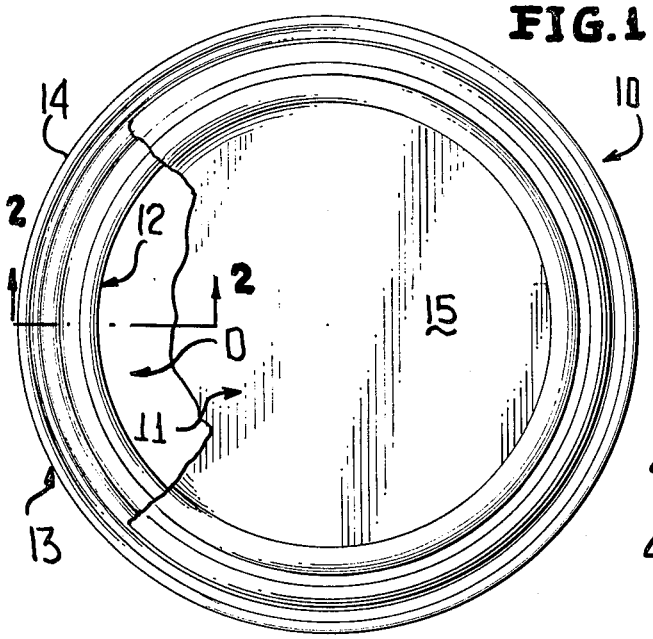
FIG. 1 is a top plan view of a ring and plug closure constructed in accordance with this invention and illustrates a ring and plug thereof.
Figure 3:
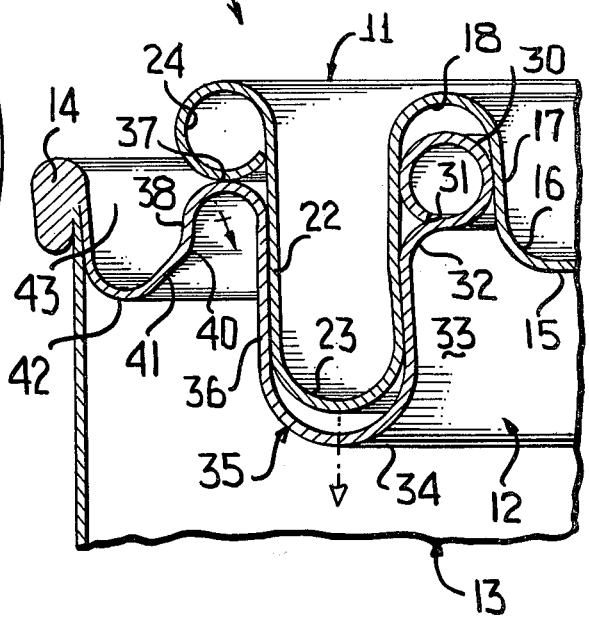
FIG. 3 is a fragmentary sectional view similar to FIG. 2 and illustrates the plug portion of the plug received in the annular channel of the ring with a curl of the plug resting atop the radius of the ring and the frusto-conical wall of the latter in its normal nondeflected condition.
Figure 4:
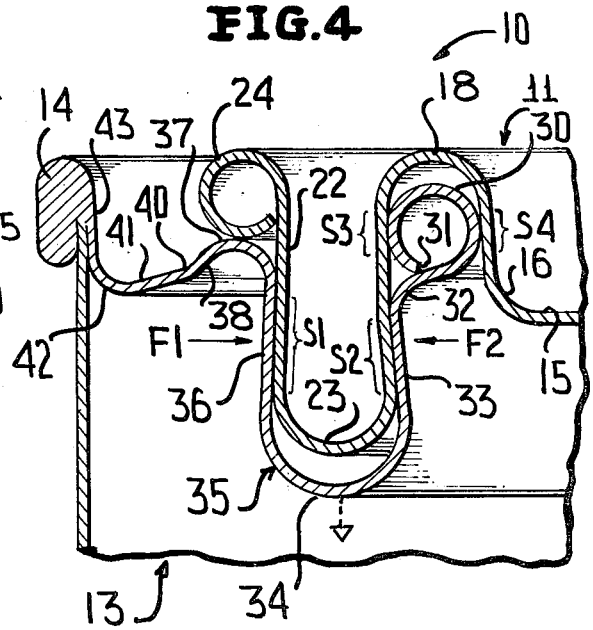

FIG. 4 is a fragmentary sectional view similar to FIG. 3, and illustrates the final position of the ring and plug after the frusto-conical wall has been deflected under the influence of the downward movement of the plug curl to deflect the outer walls of the plug portion and annular channel inwardly to effect a tight gripping action between the walls of the annular channel and the walls of the plug portion.

Figure 5:
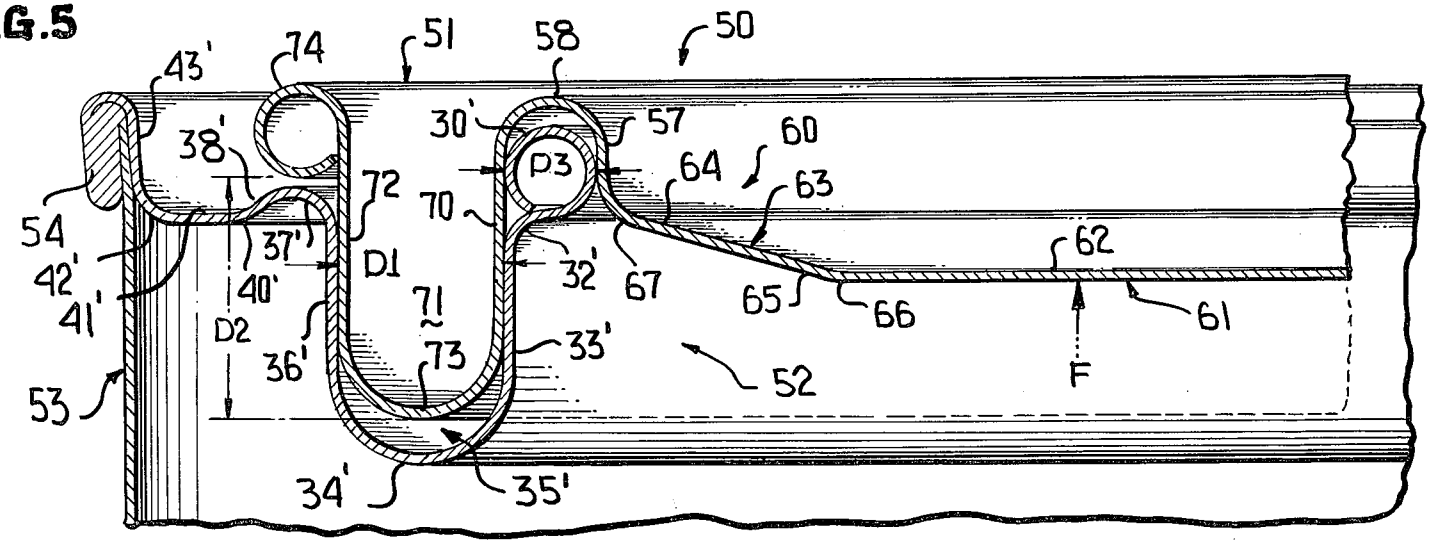

FIG. 5 is a fragmentary sectional view similar to FIG. 4, and illustrates the final position of another embodiment of the ring and plug closure of this invention, and illustrates a shock absorbing feature thereof including a central generally circular unreinforced concavely axially outwardly opening end panel and outwardly thereof a frusto-conical annular wall.

Figure 6:
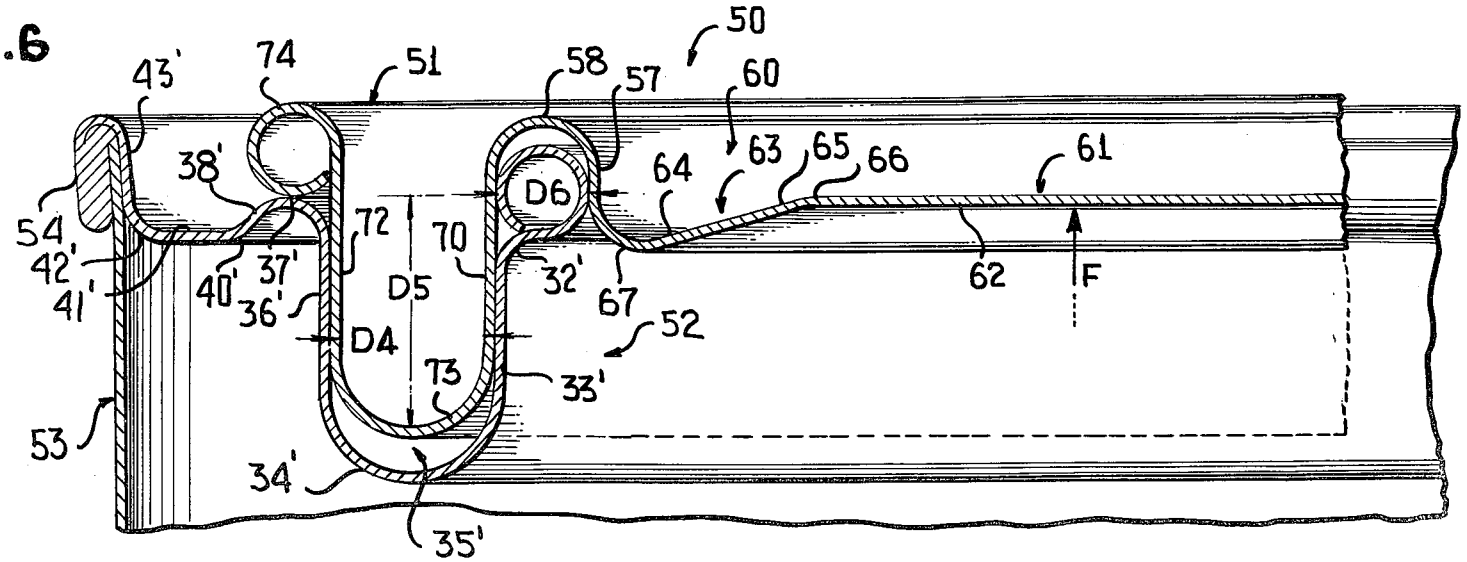

FIG. 6 is a fragmentary sectional view of the shock absorbing ring and plug closure of FIG. 5, and illustrates the manner in which the end panel reverses itself from a concave to a convex position following abnormal forces applied to the closure and/or its associated container.

A novel plug and ring closure or friction closure constructed in accordance with this invention is generally designated by the reference numeral 10 and includes a plug 11 and a ring 12. The ring 12 includes an outer peripheral portion (unnumbered) which is secured to a container body 13, such as a conventional one gallon paint can by a conventional double seam which is generally designated by the reference numeral 14. The container or can 13 includes a conventional bottom (not shown) double seamed thereto or integrally formed therewith.

The plug 11 of the ring and plug closure 10 is formed of metallic material and includes a central circular panel 15 merging with a radius 16 which in turn merges with a radially innermost annular wall 17. The annular wall 17 in turn merges with a downwardly opening channel, radius or radius wall 18, and the latter merges with an inner wall 20 of a plug portion 21 which additionally includes an outer annular plug wall 22 and a bight or bight wall 23. The outer annular plug wall 22 terminates in an outwardly downwardly and inwardly directed curl 24.

A dimension D1 represents the predetermined distance between the outer surfaces of the walls 20, 22 of the plug portion 21. The predetermined dimension D2 represents the axial distance between the bottommost portion of the curl 24 and the bottommost portion of the bight or bight wall 23. The distance D3 represents the diameter of the radius 18 and the predetermined distance between the annular walls 17, 20. The distances D1 through D3 have a significance which will be described hereinafter in conjunction with and relative to the ring 12.

The ring 12 is also constructed from metallic material and includes an opening generally designated by the reference numeral character O which is defined by an upwardly outwardly and inwardly directed reverse curl 30 having a terminal edge 31 terminating adjacent a radius 32. The radius 32 merges with an inner friction or channel wall 33 of a generally U-shaped, upwardly opening channel 35 which includes an upwardly opening bight or bight wall 34 and an outer friction or channel wall 36. The walls 33, 36 are generally normally in parallel relationship to each other or taper very slightly in a converging manner in an upward direction, as viewed in FIG. 2 of the drawing. The wall 36 merges with a downwardly opening radius 37 which is joined by a very short cylindrical wall portion 38 to a very short radius 40 which in turn is joined to and merges with a frusto-conical wall 41 and another radius 42 defining an arc of approximately 135°. The radius 42 is integrally joined to a conventional chuck wall 43 which is in turn united to the container body 13 by the double seam 14.

Figure 2:
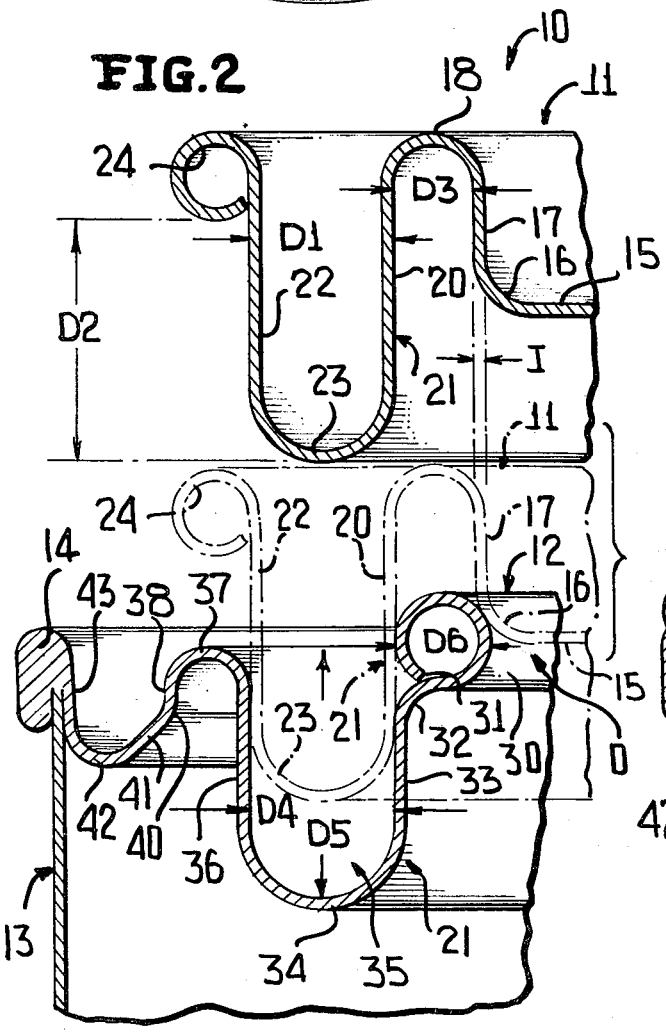
FIG. 2 is an enlarged fragmentary sectional view taken generally along line 2—2 of FIG. 1 and illustrates two positions of the plug relative to the ring and a frusto-conical wall of the ring joined by a radius to an inner channel wall of a U-shaped or annular channel which receives a plug portion of the ring.

The frusto-conical wall 41 defines means which are responsive to the insertion of the plug portion 21 into the channel 35 for radially inwardly deflecting the outer channel wall 36 from the position shown in FIG. 2 to the position shown in FIG. 4, as will be described more fully hereinafter, to create an effective and high frictional gripping action between the respective walls 22, 36 and 20, 33. However, prior to the insertion of the plug 21 into the annular channel 35 of the ring 12, the frusto-conical wall 41 is disposed at an angle of approximately 45° to a plane normal to the axis of the ring and/or plug and/or container body, as is readily apparent from FIGS. 2 and 3 of the drawings. As in the case of the plug 11, the ring 12 includes three predetermined dimensions pertinent to the present invention, one being the predetermined distance D4 which is the distance between the inner surfaces of the walls 33, 36. The predetermined distance D5 is the distance measured axially from the uppermost portion of the radius 36 to the lowermost inner surface of the bight or bight wall 34. The dimension D6 is the exterior diameter of the curl 30. The distance D6 is greater than the distance D3, and the difference therebetween is represented in FIG. 2 by the reference character I which indicates the interference between the size of the curl 30 relative to the radius 18 prior to assembly. Furthermore, while the walls 33, 36 might be parallel and, therefore, equally spaced axially the distance D4 therebetween, the walls may converge or taper upwardly slightly which is the minimum taper produced from tooling to effect a slip fit to a minimum interference fit between the plug portion 21 of the plug 11 and the channel 36 of the ring 12. The dimension D2 is at all times less than the distance D5.

After a product has been packaged in the container body 13, the plug 11 is axially aligned with the opening O, as indicated in solid lines in FIG. 2, and is then moved toward and to the phantom outline position shown in FIG. 2. In the phantom outline position of FIG. 2, the walls 20, 22 are in frictional bearing contact with the inner surfaces of the respective walls 33, 36, and if at any time prior to such insertion the distance D4 was less than the distance D1, then the walls 33, 36 would spread slightly to accommodate the plug portion 21. The latter is thus far typical of the conventional insertion of a conventional plug portion into a conventional ring channel. During the continued insertion of the plug portion 21 into the ring channel 35 a position is eventually reached at which the bottom of the plug curl 24 contacts and rests upon the uppermost portion of the radius 37, as is illustrated in FIG. 3. At this point, the reverse curl 30 is introduced into the radius 18 and, thus, the interference I is overcome by the inward deflection of the wall 17, as is evident in FIG. 3. In the position shown in FIG. 3, the predetermined angle (generally 45°) of the frusto-conical wall 41 remains unchanged from the original position of FIG. 2 prior to the introduction of the plug portion 21 into the angular channel 35.

As a continued downward axial force is applied to the plug 11, the curl 24 bears against the radius 37 and this force is transmitted to the frusto-conical wall 41 to cause the latter to progressively deflect radially inwardly and downwardly to progressively reduce the angles of the frusto-conical wall 41 from the original 45° to 44°, 43°, 42°, etc., until the same approaches or reaches a plane normal to the axis of the ring 11, the plug 12, and the container body 13, as is most readily apparent from FIG. 4 at which time a complete seal is effected between the plug 11 and the ring 12. During this downward insertion of the plug portion 21 into the channel 35, the relative dimensions D2, D5 remain unchanged and, thus, the bight 23 of the plug portion 21 never contacts the bight 34 of the annular channel 35. Accordingly, the axial downward force of the plug 11 upon deflecting the frusto-conical wall 41 progressively downwardly and inwardly creates ever increasing inwardly directed forces F1 through the radiuses 40, 37 and, thus, inwardly deflecting the outer channel wall 36, as indicated by the forces F1 of FIG. 4. These forces F1 about the periphery of the wall 36 deflect the latter radially inwardly and likewise deflect the outer plug wall 22 radially inwardly creating an upwardly converging relationship between the walls 22, 36 and 20, 33, as is readily evident from FIG. 4. The forces F1 are not simply directed radially inwardly, as indicated in FIG. 4 but, obviously, travel through the metal of the channel 35 and result in (a) a slight bulging in the overall diameter of the bight wall 34 as compared to the normal dimension thereof shown in FIGS. 2 and 3, (b) a progressive convergence of the walls 20, 33 relative to the walls 22, 36 as the bight wall 34 progressively bulges to the position shown in FIG. 4, and (c) continued inward deflection of the annular wall 17 as the curl 30 seats fully within the radius 18. In the final seated condition (FIG. 4) of the plug 11 relative to the ring 12, a quad-seal or four seals are created, and these are generally designated in FIG. 4 by the reference characters S1, S2, S3 and S4. Furthermore, due to the upward convergence of the walls 22, 36 relative to the walls 20, 33, a snap lock, so to speak, is created between the plug portion 21 and the channel 35 which precludes the accidental "popping" of the plug 11. In order to remove the plug 11, a tool, such as the blade end of a screwdriver, must be inserted beneath the curl 24 and the latter progressively wedged upwardly to relieve the forces F1 acting against the wall 36 by in effect permitting the frusto-conical wall 41 to rebound from the position shown in FIG. 4 to the position shown in FIG. 3 after which the plug or portion 21 can be readily removed from the channel 35.

It is also pointed out that during the transformation of the plug and ring from the position shown in FIG. 3 to that shown in FIG. 4, the curl 30 also further slightly moves forward toward the radius 18 thereby additionally deflecting the plug wall 20 radially outwardly by imparting thereto forces F2. Thus, though the deflection of the frusto-conical wall from the position shown in FIGS. 2 and 3 to the position shown in FIG. 4 is the major motivation for creating the four seals S1 through S4 and the snap lock of the convergent walls 22, 36 and 20, 33, the latter are also augmented by the forces F2 attributed to the dimensional relationships of the radius 18 and the curl 30.

Reference is now made to FIGS. 5 and 6 of the drawings wherein is illustrated another novel plug and ring closure or friction closure constructed in accordance with this invention and the same is generally designated by the reference numeral 50. Many elements of the closure 50 which correspond to elements of the closure 10 are identically numbered and primed for convenience as, for example, the radius 40', the wall 41', the radius 42', etc. As in the case of the closure 10, the plug and ring closure 50 includes a plug 51 and a ring 52. The ring 52 includes an outer peripheral portion (unnumbered) which is secured to a container body 53, such as a conventional one gallon paint can by a conventional double seam which is generally designated by the reference numeral 54. The container or can 53 includes a conventional bottom (not shown) double-seamed thereto or integrally formed therewith.

The plug 51 of the ring and plug closure 50 is formed of metallic material and is designed to resist shock forces imparted thereto under abuse of the closure and/or its container, as for example, when the same is dropped. The shock absorbing feature includes wall means 60 which includes a central generally circular unreinforced concavely axially outwardly opening wall 61 including a central circular end panel 62 and a frusto-conical annular wall 63 having a major circumferential portion 64 and a minor circumferential portion 65 with the latter being joined by a first radius wall 66 to the end panel 62. The first radius wall 66 is spaced by the frusto-conical annular wall 63 from a second radius wall 67 which is in turn merged with a radially innermost annular wall 57 of the plug 51. The wall means 63 and particularly the components 61–67 thereof effect deflection of the end panel 62 and the frusto-conical annular wall from its normally axially outwardly concavely opening condition (FIG. 5) to a convexly axially outwardly projecting position (FIG. 6) in response to shock forces imparted to the closure and/or its associated container thereby absorbing such shock forces to prevent "plug popping". Such forces are indicated by the line of force F in FIGS. 5 and 6, and it is to be understood that this force F might be created simply by dropping the container which, when packaged with a liquid such as paint, exerts a force against the closure and any of its components 61 through 67 tending to "pop" the plug 51, but in lieu thereof the force F of FIG. 5 simply is absorbed by the flexure or movement of the panel from the position shown in FIG. 6 to that shown in FIG. 5.

The annular wall 57 of the plug 51 in turn merges with a downwardly opening channel, radius or radius wall 58, and the latter merges with an inner wall 70 of a plug portion 71 which additionally includes an outer annular plug wall 72 and a bight or bight wall 73. The outer annular plug wall 72 terminates in an outwardly, downwardly and inwardly directed curl 74.

The dimensions D1, D2 and D3 associated with the plug 51 corresponds to the respective dimensions D1–D3 of the plug or plug portion 21 and thus a further description thereof is unnecessary.

The ring 52 is identical in construction to the ring 12 and thus the various components of the ring 52 corresponding to those of the ring 12 have simply been added to FIGS. 5 and/or 6 of the drawings are are primed to reflect the identity of structure and function, including the dimensions D4, D5 and D6. Accordingly, the operation of the structure of the plug 51 and its cooperation with the ring 52 is identical to that heretofore described relative to the plug 11 and the ring 12 of the plug and ring closure 10, particularly in regard to the operation of the elements 40', 41', 42', etc., which functions identically to the like elements of the closure 10 during the insertion of the plugs 11 or 51 (FIGS. 2 and 3) into the rings 12 or 52 (FIGS. 4 and 5, 6).

Although only a preferred embodiment of the invention has been specifically illustrated and described herein, it is to be understood that minor variations may be made in the apparatus without departing from the spirit and scope of the invention, as defined in the appended claims.

I claim:

1. A two-piece shock absorbing closure for use with a container comprising a ring and a plug, said plug including a central generally circular unreinforced concavely axially outwardly opening end panel, an annular axially projecting plug portion bounding said end panel, said ring including an axially opening annular channel adapted to receive said plug portion, said annular channel being defined by inner and outer channel walls and a bight wall therebetween, means radially outboard of said outer channel wall responsive to insertion of said plug portion into said annular channel for radially inwardly deflecting said outer channel wall to bring the same into intimate friction engagement with said plug portion, and wall means between said end panel and said plug portion for effecting the deflection of said end panel from its concave configuration to a convex configuration in response to shock forces imparted to said closure and/or its associated container thereby absorbing such shock forces to prevent plug popping.

2. The two piece closure as defined in claim 1 wherein said plug portion is defined by inner and outer annular plug walls and a bight wall therebetween, said deflecting means is further operative for radially inwardly deflecting said outer annular plug wall, and said wall means includes a frusto-conical annular wall having major and minor circumferential portions, said minor circumferential portion being joined by a first radius wall to said end panel, and at least a second radius wall joining said major circumferential portion to said inner annular plug wall.

3. The two-piece closure as defined in claim 1 wherein said deflecting means is a frusto-conical wall inclined at a predetermined angle to the plane of said outer channel wall, and said predetermined angle progressively reduces as said deflecting means becomes operative with the insertion of said plug portion into said annular channel.

4. The two-piece closure as defined in claim 1 wherein said plug and ring include a curl and radius disposed in axial alignment upon the insertion of said plug portion into said channel, said radius being disposed between said deflecting means and said outer channel wall, said curl and radius being in contact upon the full insertion of said plug portion into said channel, and the axial distance between the point of contact and a terminal end of said plug portion being less than the axial distance between the point of contact and a mid portion of said bight wall whereby axial force imparted to said curl after contact with said ring is transmitted through said radius to render said deflecting means operative.

5. The two-piece closure as defined in claim 1 wherein said plug portion is defined by inner and outer annular plug walls and a bight wall therebetween, said inner and outer annular plug walls being of a predetermined spaced radial distance prior to the operation of said deflecting means, and said predetermined distance being reduced by the deflection of said outer channel wall by said deflecting means.

6. The two-piece closure as defined in claim 2 wherein said deflecting means is a frusto-conical wall inclined at a predetermined angle to the plane of said outer channel wall, and said predetermined angle progressively reduces as said deflecting means becomes operative with the insertion of said plug portion into said annular channel.

7. The two-piece closure as defined in claim 2 wherein said plug and ring include a curl and radius disposed in axial alignment upon the insertion of said plug portion into said channel, said radius being disposed between said deflecting means and said outer channel wall, said curl and radius being in contact upon the full insertion of said plug portion into said channel, and the axial distance between the point of contact and a terminal end of said plug portion being less than the axial distance between the point of contact and a mid-portion of said bight wall whereby axial force imparted to said curl after contact with said ring is transmitted through said radius to render said deflecting means operative.

8. The two-piece closure as defined in claim 2 wherein said inner and outer annular plug walls being of a predetermined spaced radial distance prior to the operation of said deflecting means, and said predetermined distance being reduced by the deflection of said outer channel wall by said deflecting means.

9. The two-piece closure as defined in claim 2 wherein said inner annular plug wall merges with a radius in axially opposed relationship to a curl which merges with said inner channel wall, and said last-mentioned radius is joined to said second radius wall.

10. The two-piece closure as defined in claim 2 wherein said inner annular plug wall merges with a radius in axially opposed relationship to a curl which merges with said inner channel wall, said last-mentioned radius is joined to said second radius wall, said inner and outer annular plug walls being of a predetermined spaced radial distance prior to the operation of said deflecting means, said radius being of a predetermined diameter sufficient to accommodate said curl and define two lines of sealing at diametrically opposite sides of said curl, and said predetermined radial distance being reduced by the deflection outer channel wall and said outer annular plug wall by said deflecting means.

11. The two-piece closure as defined in claim 3 wherein said plug and ring include a curl and radius disposed in axial alignment upon the insertion of said plug portion into said channel, said radius being disposed between said deflecting means and said outer channel wall, said curl and radius being in contact upon the full insertion of said plug portion into said channel, and the axial distance between the point of contact and a terminal end of said plug portion being less than the axial distance between the point of contact and a mid-portion of said bight wall whereby axial force imparted to said curl after contact with said ring is transmitted through said radius to render said deflecting means operative.

12. The two-piece closure as defined in claim 3 wherein said plug portion is defined by inner and outer annular plug walls and a bight wall therebetween, said inner and outer annular plug walls being of a predetermined spaced radial distance prior to the operation of said deflecting means, and said predetermined distance being reduced by the deflection of said outer channel wall by said deflecting means.

13. The two-piece closure as defined in claim 3 wherein said plug portion is defined by inner and outer annular plug walls and a bight wall therebetween, said deflecting means being operative for radially inwardly deflecting said outer annular plug wall, and said inner annular plug wall merges with a radius in axially opposed relationship to a curl which merges with said inner channel wall.

14. The two piece closure as defined in claim 3 wherein said plug portion is defined by inner and outer annular plug walls and a bight wall therebetween, said deflecting means being operative for radially inwardly deflecting said outer annular plug wall, said inner annular plug wall merges with a radius in axially opposed relationship to a curl which merges with said inner channel wall, said inner and outer annular plug walls being of a predetermined spaced radial distance prior to the operation of said deflecting means, said radius being of a predetermined diameter sufficient to accommodate said curl and define two lines of sealing at diametrically opposite sides of said curl, and said predetermined radial distance being reduced by the deflection outer channel wall and said outer annular plug wall by said deflecting means.

15. A two-piece shock absorbing closure for use with a container comprising a ring and a plug, said ring including an axially opening annular channel adapted to receive a plug portion of said plug, said annular channel being defined by inner and outer channel walls and a bight wall therebetween, said inner and outer channel walls being spaced a predetermined distance from each other, said plug portion being defined by inner and outer annular plug walls and a bight wall therebetween, a central generally circular unreinforced concavely axially outwardly opening end panel inboard of said inner annular plug wall, wall means between said end panel and said inner annular plug wall for effecting the deflection of said end panel from its concave configuration to a convex configuration in response to shock forces imparted to said closure and/or its associated container thereby absorbing such shock forces to prevent plug popping, said inner and outer annular plug walls being spaced a predetermined distance from each other sufficiently to frictionally engage said inner and outer channel walls upon the insertion of said plug portion into said annular channel, said outer annular plug wall merging with a curl and said outer channel wall merging with a radius, said curl and radius being in axial alignment whereby upon the insertion of said plug portion into said annular channel said curl will contact said radius, means for securing a periphery of said ring to a container, means disposed between said securing means and said radius and responsive to axial movement of said radius by said curl upon the forceful introduction of said plug portion into said annular channel for radially inwardly deflecting said outer channel wall and said outer annular plug wall to decrease the predetermined distance of each at an area between said radius and said channel bight wall thereby increasing the frictional contact between said inner and outer channel walls and said inner and outer annular plug walls.

16. The two-piece closure as defined in claim 15 wherein said inner annular plug wall merges with a radius and said inner channel wall merges with a curl, said wall means includes a frusto-conical annular wall having major and minor circumferential portions, said minor circumferential portion being joined by a first radius wall to said end panel, and a second radius wall joining said major circumferential portion to said radius which merges with said inner annular plug wall, and said last-mentioned radius and curl are dimensioned to frictionally engage each other and define generally diametrically opposite sealing lines upon the introduction of said plug portion into said channel.

17. The two-piece closure as defined in claim 15 wherein said deflecting means is a frusto-conical wall inclined at a predetermined angle to the plane of said outer channel wall, and said predetermined angle progressively reduces as said first-mentioned curl bears against and axially moves said first-mentioned radius upon the progressive insertion of said plug portion into said annular channel.

18. The two-piece closure as defined in claim 16 wherein said deflecting means is a frusto-conical wall inclined at a predetermined angle to the plane of said outer channel wall, and said predetermined angle progressively reduces as said first-mentioned curl bears against and axially moves said first-mentioned radius upon the progressive insertion of said plug portion into said annular channel.

19. The two-piece closure as defined in claim 18 including a radius between said securing means and said frusto-conical wall.

20. The two-piece closure as defined in claim 18 including a short radius between said frusto-conical wall and said first-mentioned radius.

21. The two-piece closure as defined in claim 20 including a radius between said securing means and said frusto-conical wall.

* * * * *